United States Patent [19]

Asfour

[11] 4,047,536

[45] Sept. 13, 1977

[54] METHOD OF MAKING CIGARETTES AND A CIGARETTE MADE ACCORDING THERETO

[76] Inventor: Emil S. Asfour, Waugirain 21, 8704 Herrliberg, Switzerland

[21] Appl. No.: 586,917

[22] Filed: June 16, 1975

[30] Foreign Application Priority Data

June 19, 1974 Switzerland ..... 8366/74
May 20, 1975 Switzerland ..... 6473/75

[51] Int. Cl.[2] ..... A24B 1/02
[52] U.S. Cl. ..... 131/140 C
[58] Field of Search ..... 131/84 R, 31, 140

[56] References Cited

U.S. PATENT DOCUMENTS

| | | | |
|---|---|---|---|
| 3,431,915 | 3/1969 | Licis | 131/140 C |
| 3,472,236 | 10/1969 | Dearsley | 131/84 R X |
| 3,817,258 | 6/1974 | Ernow | 131/131 |

*Primary Examiner*—Stephen C. Pellegrino
*Attorney, Agent, or Firm*—Cushman, Darby & Cushman

[57] ABSTRACT

Method of producing a smoking article from an endless web of reconstituted tobacco having a mass per unit length substantially equal to that of the smoking article to be made. The method includes longitudinally grooving the web while preventing any substantial transverse contraction so as to form a plurality of closely spaced narrow longitudinal corrugations. The grooved web is then laterally stretched to form closely laterally spaced narrow zones of lesser thickness extending longitudinally of the web wherein the fibers of the web material are loosened and exposed to provide projecting fiber ends and a plurality of discontinuous longitudinal tears without substantially impairing the longitudinal continuity of the web.

2 Claims, 21 Drawing Figures

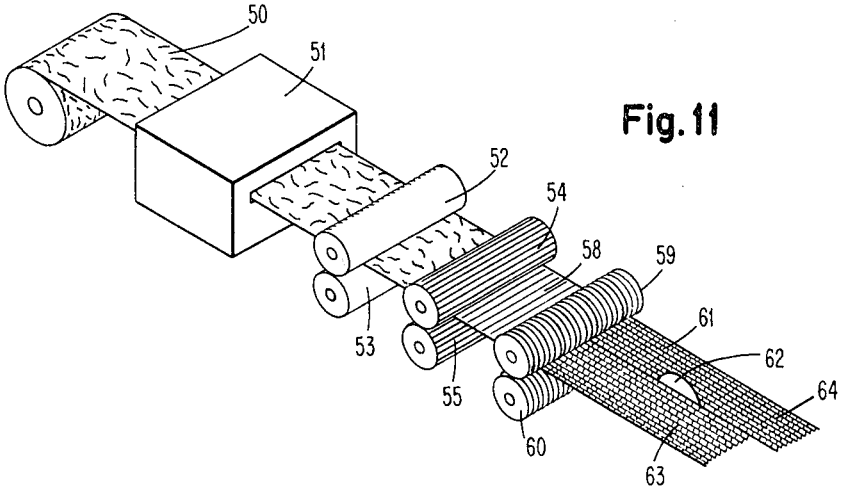
Fig. 11
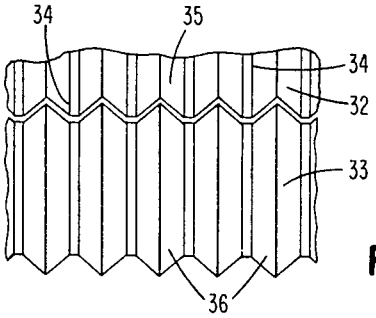
Fig. 5
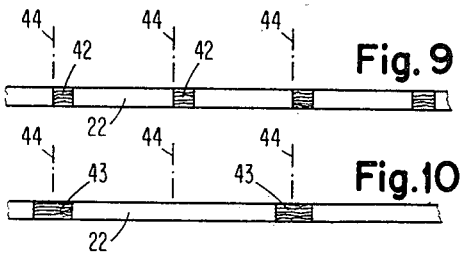
Fig. 9
Fig. 10
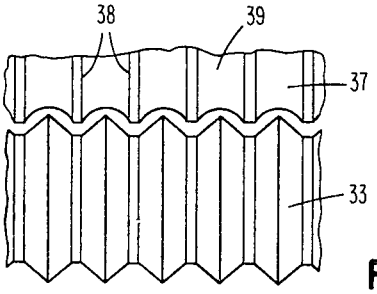
Fig. 6
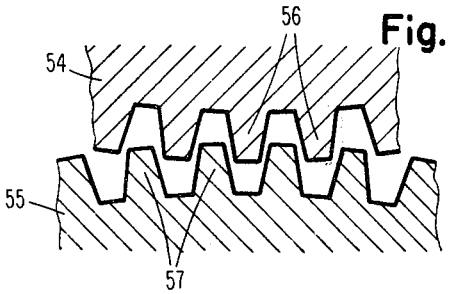
Fig. 12
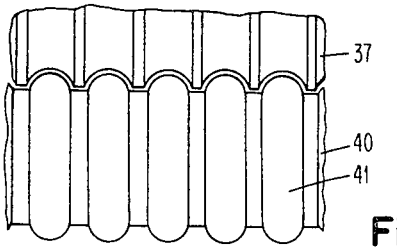
Fig. 7
Fig. 8
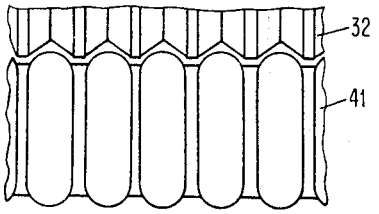

Fig. 13
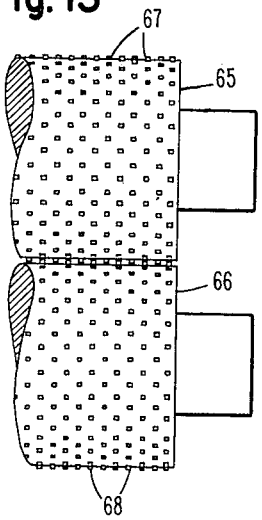
Fig. 15
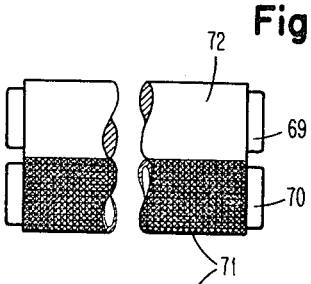
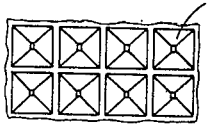
Fig. 16
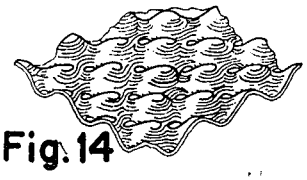
Fig. 14
Fig. 17
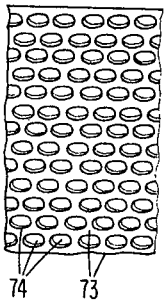
Fig. 18
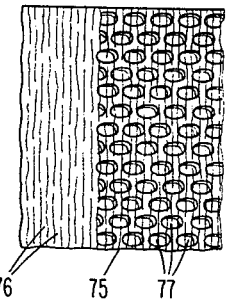
Fig. 19
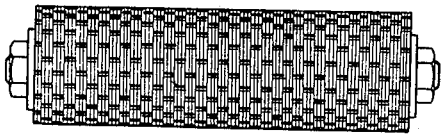
Fig. 20
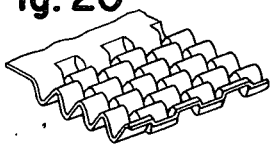
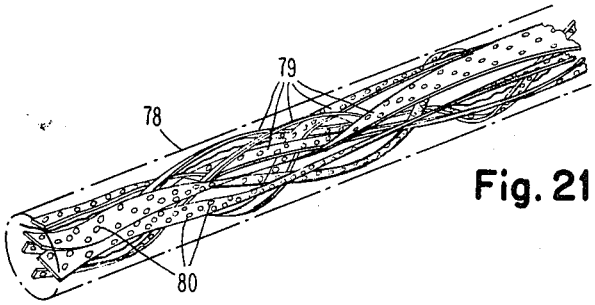
Fig. 21

METHOD OF MAKING CIGARETTES AND A CIGARETTE MADE ACCORDING THERETO

The present invention relates to a method of making cigarettes of which the filling at least partly consists of smoking foil. The term 'smoking foil' in the context of this invention covers both so-called tobacco foil which consists largely of tobacco components, possibly with a binder, and foil made of so-called artificial tobacco, i.e. tobacco substitutes which may be used in tobacco products.

The smoking tobacco obtained by cutting leaves is for many purposes, including the filling of cigarettes, blended with a certain percentage of finely cut and shredded smoking foil. The advantage of such foil made of tobacco components or tobacco substitutes resides in the fact that owing to their mode of production they possess well-defined properties which are not subject to alteration in contradistinction to smoking tobacco made of the leaves of the tobacco plant which is subject to climatic influences and may vary substantially depending on its origin. Manufacture of tobacco foil is effected according to various known methods, by way of example by an extrusion process, a flotation method, a microflake process or a method similar to that employed in paper-making, the base material being tobacco plants in all cases. Smoking foil made of tobacco substitutes is also known. All such foil has the common feature that it forms thin webs of material with plane flat surfaces so that they have so far required cutting and shredding for further processing in order to be added to the usual smoking tobaccos. Further processing of such blends of natural tobacco and tobacco foil is effected in the known manner.

Since smoking foil made according to up-to-date methods offers the possibility of improving certain disadvantageous properties of tobacco in production and of refining the smoke produced in smoking in many respects by additions, cigarettes made largely or exclusively of such smoking foil command a degree of interest. It is naturally not possible to wind spirally and then smoke a thin smooth tobacco foil of a width of e.g. 10 cm since such a spirally wound foil web naturally presents excessive resistance to drawing in the longitudinal direction in order that the smoke may be sucked through from the tip. Again, in making a filling material resembling cut tobacco for cigarettes by cutting and shredding smoking foil the smoothness of the shreds constitutes a disadvantage.

The present invention has for its object to eliminate this disadvantage and relates to a method of making tobacco products, particularly cigarettes, of which the filling at least partly consists of smoking foil. The method according to this invention is characterized in that

- at least one flat smoking foil in the shape of an endless web is unwound from a supply roll and continuously moved away;
- it is shaped in the process and provided with projecting structures,
- and subsequently processed into smoking material for smoker's products.

The invention furthermore relates to a cigarette made by the method according to the invention and characterized by a wrapped filling to be smoked which contains at least portions of a smoking foil provided with structures projecting from the web plane.

Several embodiments of the invention will now be discussed with reference to FIGS. 1 through 21 of the drawing in which FIG. 1 is a diagrammatic perspective view of an embodiment for an apparatus for the performance of the method according to the invention;

FIGS. 5 through 8 are part views of further embodiments of pairs of associated shaping rolls similar to those of FIG. 2;

FIGS. 9 and 10 are views of a portion of a wrapping web as may be used in the apparatus according to FIG. 1;

FIG. 11 is a view corresponding in part to FIG. 1 showing another embodiment of an apparatus for the performance of the method according to the invention;

FIG. 12 is a cross-section of an embodiment of two associated shaping rolls with axially disposed ribs;

FIGS. 13 and 14 are views of an embodiment of two associated shaping rolls and of the shaped tobacco foil web made therewith;

FIGS. 15 and 16 are views of a further embodiment of shaping rolls similar to those of FIG. 13 and of an enlarged diagrammatic representation of the surface of one of these shaping rolls;

FIGS. 17 and 18 are plan views of a shaped tobacco foil web in diagrammatic representation;

FIGS. 19 and 20 show yet a further embodiment according to FIGS. 13 and 14, and FIG. 21 is a diagrammatic perspective view of gathered and wrapped tobacco foil strips.

Figure 1:
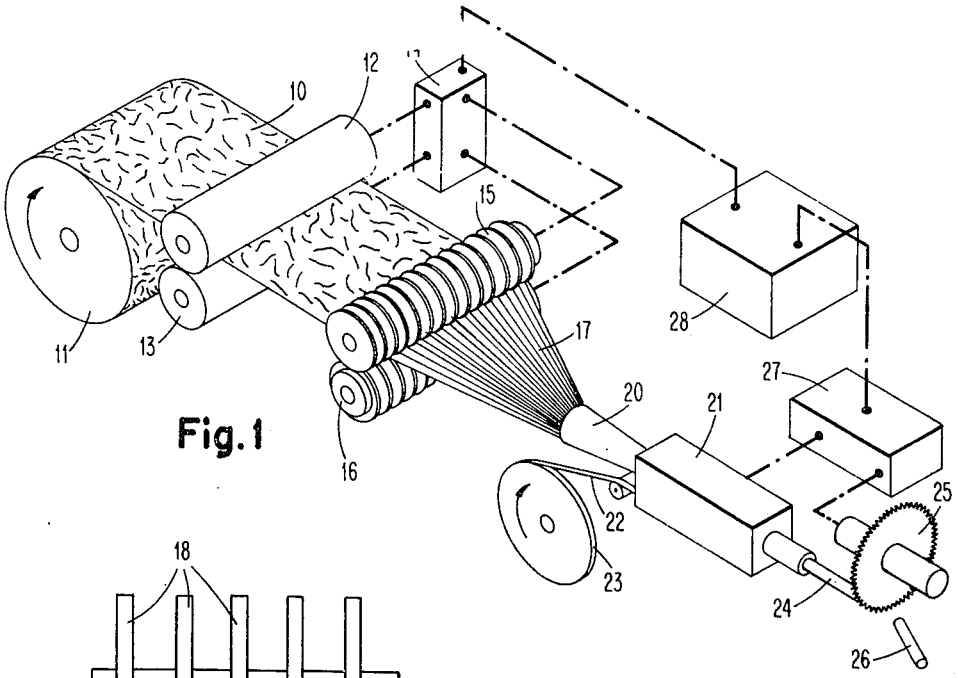

The method will now be described as applied to making cigarettes, it being understood, however, that it is not limited to cigarettes but may be applied to making other smoker's products, such as cigars. In the place of the tobacco foil mentioned, all other smoking foils made of any material suitable as smoking material may be employed.

The present method will first be discussed with reference to the diagrammatic view of FIG. 1 for making cigarettes consisting entirely of tobacco foil. The tobacco foil which may have a weight of 50 g/m$^2$ and a width of 20 to 25 cm is drawn off the supply roll 11 as an endless web in the direction of the arrow and passes between the two associated rolls 12 and 13 which in the present case are both rotated at the same rate which is infinitely variable by the drive 14 indicated diagrammatically. The diameters of the two rolls 12, 13 are advantageously identical and their surface is either smooth or slightly roughened. The tobacco foil web 10 then passes to a pair of shaping rolls 15, 16 which may also be rotated infinitely variably by the drive 14 as shown diagrammatically. The drive 14 and its appropriate design will be described in greater detail below.

Figure 2:
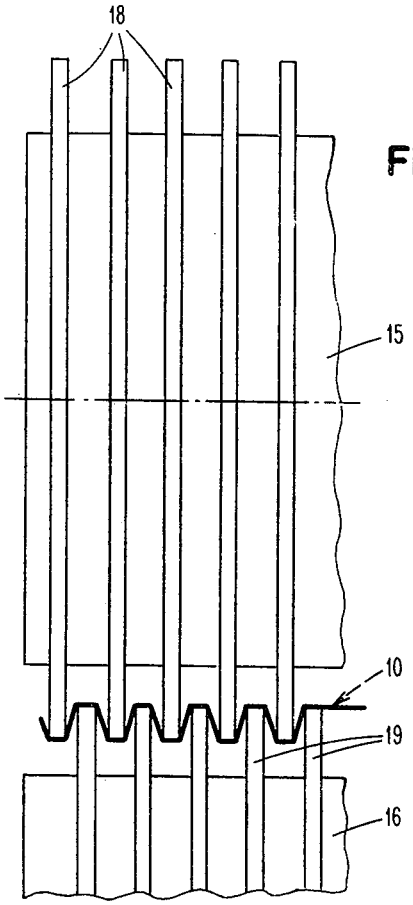
FIG. 2 is a view of a portion of the pair of associated shaping rolls of the apparatus according to FIG. 1.
Figure 3:
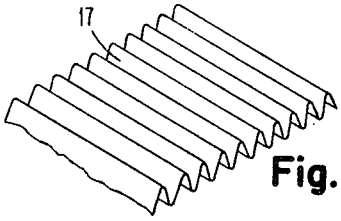
FIG. 3 is a diagrammatic perspective view of a specimen of a tobacco foil web shaped in the apparatus according to FIG. 1.

The shaping rolls 15, 16 provide the tobacco foil web passing between them with structures projecting from the web plane. In the present embodiment the shaped tobacco foil web 17, when leaving the shaping rolls 15, 16, presents the cross-section diagrammatically shown in FIG. 3 and thus possesses ribs arranged in the longitudinal direction and in parallel. The shape of the ribs and other characteristics of the tobacco foil web 17 substantially depend on the configuration of the shaping rolls 15, 16. The regular longitudinal ribs shown in FIG. 3 are by way of example produced by shaping rolls 15, 16 shown at an enlarged scale in FIG. 2. The upper shaping roll 15 is provided with a number of annular ribs 18 which engage with similar annular ribs 19 of the lower shaping roll 16. Sensitive adjustment of the distance of the axes of the shaping rolls 15 and 16 enables the engagement of the annular ribs 18 and 19 to be adjusted. The tobacco foil web 10 passing through the gap between the mutually engaging shaping rolls 15 and 16 obtains a permanent shape if engagement between the rolls is properly adjusted, and when leaving the gap it has the cross-section according to FIG. 3. Depending on the thickness and the composition of the tobacco foil web 10 it may be of advantage to heat the shaping rolls 15, 16 to a temperature up to about 400° C. Further details of the design of appropriate shaping rolls 15, 16 will be given below.

As FIG. 1 shows, the shaped tobacco foil web 17 then passes into the inlet funnel 20 of a rope-forming machine 21 of known design. The shaped tobacco foil web is there gathered into an endless rope of substantially circular cross-section to which end the narrow paper band 22 is supplied in the direction of the arrow from the supply roll 23. The wrapping band is pasted together as usual along an overlapping seam so that an endless wrapped rope 24 is formed which has a diameter of e.g. 7.8 to 8.6 mm according to the diameter of the cigarettes to be made. This rope is cut into rods 26 of cigarette length, which then form the completed cigarettes, by a cutting device here shown as a rotating blade 25.

Such a cigarette 26 thus holds in its wrap a filling which consists of a continuous tobacco foil. Owing to the gathering of the shaped tobacco foil web 17 it is arranged in a plurality of irregular layers. Owing to the structures projecting from the plane of the web, the longitudinal ribs in the present case, there are formed between adjacent layers a plurality of passages permeable to smoke which extend approximately in the longitudinal direction of the cigarette filling. When such a cigarette formed by only one shaped tobacco foil web is smoked, even burning and a resistance to suction corresponding to that of normal cigarettes is ensured by the plurality of the longitudinal passages and the structure of the tobacco foil web.

In the apparatus shown in FIG. 1 it must be ensured that the drive 27 of the rope forming machine 21 and of the cutting device 25 here shown diagrammatically is synchronized with the drive 14 for the conveying rolls 12, 13 and the shaping rolls 15, 16. This may be achieved by providing tachometer generators in the drives 14 and 27 of which the signals are compared in a control unit of known design and which supply a control signal for the automatic synchronization of the drives 14, 27. Such an arrangement offers the advantage that various rope-forming machines 21 of known design can operate together with an apparatus for shaping a tobacco foil web. With drive 14 it should advantageously be provided that the rate of revolutions of the two conveying rolls 12, 13 may be altered relative to the rate of revolutions of the two shaping rolls 15, 16 since it is expedient for many tobacco foil webs to increase the circumferential speed of the shaping rolls 15, 16 relative to the circumferential speed of the conveying rolls 12, 13 so that the tobacco foil web is longitudinally stretched between the said two pairs of rolls. When using a tobacco foil web with a weight of approx. 25 to 80 g per $m^2$ it is of advantage for the shaping rolls 15 and 16 to be provided with annular ribs 18 and 19 with a width of e.g. 0.6 mm, the distance between consecutive ribs being about 1 to 2 mm. The two shaping rolls 15, 16 are so arranged relatively to one another that the ribs 19 of the lower shaping roll 16 extend symmetrically into the spaces between the ribs 18 of the shaping roll 15 so that an air gap will be formed between the engaging ribs 18 and 19 of a width of 0.2 to 0.7 mm on either side. The ribs 18 and 19 in the present embodiment have a rectangular cross-section. Where engagement of the two shaping rolls 15, 16 is properly adjusted, it may be ensured that the flat tobacco foil web is held by the end faces of the individual adjacent ribs 18 and 19 so that it cannot slip in the direction of the roll axes with the effect that the tobacco foil web 10 is correspondingly stretched transversely between two ribs. This transverse stretching then results in the formation of the longitudinal ribs in the shaped tobacco foil web 17 as diagrammatically indicated in FIG. 3. As the tobacco foil web 10 passes between the shaping rolls 15, 16 the width transversely to the direction of motion remains virtually unchanged despite the fact that the surface of the shaped tobacco foil web 17 is naturally substantially larger than that of the unshaped tobacco foil web 17 depending on the depth of engagement of the two shaping rolls 15, 16. The tobacco foil web is thus locally thinned by such transverse stretching. An increase of the mutual engagement of the shaping rolls 15, 16 enables transverse stretching to be increased until the shaped tobacco foil web 17 obtains the appearance shown diagrammatically in FIG. 4, i.e. shows, besides the longitudinal ribs 30, a plurality of irregular tears and openings 31 extending in the longitudinal direction which have been caused by the strong stretching in the thinned areas of the tobacco foil web 17.

Figure 4:
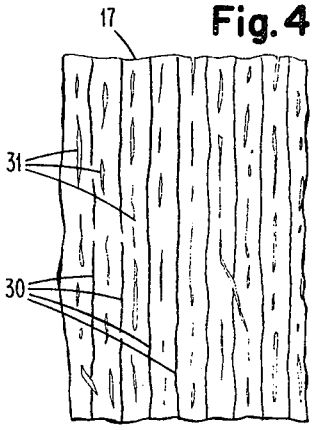
FIG. 4 is a plan view of another specimen of a tobacco foil web shaped in the apparatus according to FIG. 1.

Thinning of the tobacco foil web 17 after shaping according to FIGS. 3 and 4 ensures that the tobacco foil in the completed cigarette 26 will burn evenly and completely so that the filling will show the same behaviour as a filling made of the usual cut tobacco. Appropriate adjustment of the axial distance of the shaping rolls 15, 16 enables the degree of shaping to be adjusted to the desired value for various tobacco foil webs so that the resistance to suction of the finished cigarette 26 will be influenced. Substantial stretching in the longitudinal direction to the point where a plurality of oblong tears and openings 31 is formed is of particular advantage in a tobacco foil which contains the tobacco and/or possible additions in the form of finely distributed shorter and longer fibres because owing to the pronounced transverse stretching such fibres have one of their ends detached from the foil structure and project from its surface, which is desirable when the tobacco foil is smoked.

In the present method it is, however, of importance that, even when the shaped tobacco foil web 17 is provided with a plurality of short and discontinuous longitudinal tears 31 as per FIG. 4, the transverse continuity is not completely destroyed. The depth of engagement of the shaping rolls 15, 16 may therefore not be increased until the tobacco foil web 10 is cut into several strips since experience shows in such a case that difficulties arise in gathering the shaped tobacco foil web 17 in the transverse direction so that flawless delivery to the inlet funnel 20 of the rope forming machine 21 is no longer ensured.

The embodiment of the shaping rolls 15, 16 discussed with reference to FIG. 2, while it has stood the test of practice, constitutes only one of the possible and practicable designs of associated shaping rolls. By way of example, the flat front edges of the annular ribs 18 and/or 19 may be more or less rounded or designed as wedges so long as it is ensured that the tobacco foil web passing between them is not cut into longitudinal strips. The shaping rolls 32, 33 diagrammatically shown in FIG. 5 may also be employed, the upper shaping roll 32 being provided with annular ribs which have a flat end face 34 but wedge-type flanks 35 while the lower shaping roll 33 has wedge-type annular ribs 36 with sharp edges. The same shaping roll 33 may also co-operate with a shaping roll 37 as shown in FIG. 6 which is equipped with annular ribs with a flat end face 37 while their adjacent flanks are designed as a rounded hollow flute 39. Such a shaping roll 37 provided with hollow flutes may also co-operate with a shaping roll 40 according to FIG. 7 which possesses annular ribs 41 of which the cross-section is adjusted to the shape of the hollow flute 39. FIG. 8 finally shows the combination of the shaping rolls 32 and 41. In principle, any combination of two associated shaping rolls may be employed which produces permanent rib-type longitudinal structures in the passing tobacco foil web, it being naturally important that a plurality of such rib-type longitudinal structures is created across the width of the tobacco foil web, preferably one or two adjacent ribs per millimeter web width.

Depending on the type and composition of the tobacco foil web 10 to be processed it may be expedient to influence elasticity in the longitudinal and transverse directions prior to and/or during its passage through the shaping rolls 15, 16. By way of example, it has been found to be of advantage to store the supply roll 11 with the tobacco foil web 10, prior to its processing in an apparatus according to FIG. 1, in a cooling chamber and to cool it such a temperature that it is adequately flexible to be drawn off the supply roll 11 by the conveying rolls 12, 13 but sufficiently brittle to obtain permanent deformation into longitudinal structures, as according to FIG. 3 or 4, during its passage between the shaping rolls 15, 16. Conversely there is also the possibility in the event that brittle tobacco foil webs are involved to store the supply roll 11 at a higher temperature and/or to heat the shaping rolls 15 or 16 to a predetermined temperature and to produce the desired longitudinal structures in the passing tobacco foil web 10.

In the embodiment according to FIG. 1 employed for the present method the tobacco foil web is shaped in a single pair of shaping rolls 15, 16. It is natually also possible to employ more than one pair of rolls and to influence the structure of the flat tobacco foil web 10 prior to its entry between the shaping rolls 15, 16 by way of example by perforations, humps, embossings or other structures projecting from the surface. Although they are at least partly removed during the passage between the shaping walls 15, 16 provided with annular ribs, such pre-structuring enables the tobacco foil web to be loosened in a desired manner or possibly frayed, which has its effect on the finally shaped tobacco foil web 17.

In the embodiment of the apparatus according to FIG. 1 for the performance of the present method the endless, wrapped tobacco foil rope 24 is subdivided, as previously stated, into rods 26 of cigarette length so that finished cigarettes are obtained. However, finished cigarettes are commonly provided with a tip band also if filterless cigarettes are involved. In order to avoid an additional operation it is possible with the present method to equip the wrapping band 22, as indicated in FIG. 9, with an appropriate tip band 42 on the surface which will later form the outside and at distances of one cigarette length each. This tip band may be pasted to the paper and consist, by way of example, of imitation cork, or it is also possible to print a corresponding portion of the wrapping band 22 in colour in a suitable manner. It must naturally be ensured that the subdivision of the endless wrapped tobacco foil rope 24 is then effected exactly at one end of the tip band 42, i.e. at the points indicated by dot-dash lines 44 in FIG. 9.

To this end the cutting device may be automatically adjusted in the known manner relative to the passing wrapped tobacco foil rope 24 by means of an optical or electronic sensor (not shown). Such sensors and the associated control of the cutting device for rope forming machines are known so that a description in greater detail may be dispensed with. However, it is also possible to place a double width of the tip band 43 shown in FIG. 10 on the wrapping band so that only every second subdivision at the points 44 halves such a tip band 43. The wrapping band 22 commonly consists of thin paper and is pasted with an overlapping seam along the endless tobacco foil rope 24. Plastic bands have been proposed to replace a paper band 22, which are then welded along an ovelapping seam. The present method offers the possibility of replacing the paper band 22 by a correspondingly thin tobbacco foil which can also be closed with an overlapping seam. This will produce such a cigarette that no wrapping paper need be burned in smoking, which is as such undesirable. However, there exists also the possibility to effect wrapping by means of a wrapping band coated with a tobacco foil on its inside; the outer paper layer may then be as thin as desired since it is not called upon to withstand any mechanical stress.

The embodiment of the present method discussed above in greater detail with reference to FIG. 1 makes particularly rational production of cigarettes possible of which the filling in the wrap consists exclusively of a tobacco foil web. In this process finished cigarettes 26 are made of a flat tobacco foil 10 on a supply roll 11 in one continuous operation. The quantity of tobacco foil web held in every cigarette depends on its width. Accordingly the width of the supply roll 11 in the apparatus according to FIG. 1 must correspond to the tobacco weight per cigarette. It is naturally also possible to perform the present method in such a manner that several shaped and structurized tobacco foil webs are made from a tobacco foil web of any width and then wound to form bobbins in the known manner which are then individually conveyed to rope forming machines of conventional design, unwound and processed into cigarettes. Such an embodiment of the present method will now be described in greater detail with reference to the diagrammatic view of FIG. 11.

In the embodiment of the apparatus according to FIG. 11 the flat tobacco foil web 50 is drawn off a supply roll by two conveying rolls 52, 53 and passes through the pretreatment device 51. The width of the tobacco foil web 50 may be arbitrary since it can be subdivided into several shaped tobacco foil webs after structurizing, as explained below.

The pretreatment device 51 which may arranged in front of (as in FIG. 11) or behind the conveying rolls 52, 53 in the direction of motion of the tobacco foil web, by way of example serves for heating or cooling the passing tobacco foil web so as to influence its elasticity and ductility. If desired, the surface of the tobacco foil web 50 may in the pretreatment device 51 be treated with vapours or liquids in order to influence its flavour and burning properties in the known manner.

The flat tobacco foil web 50 then passes to a first pair of shaping rolls 54, 55 which are here provided e.g. with ribs arranged in the axial direction which may be brought mutually to engage as diagrammatically shown in FIG. 12. The axially arranged ribs 56 and 57 of the shaping rolls 54 and 55 respectively may by way of example have the wedge-type cross-section shown in FIG. 12 or be shaped similarly to the teeth of gears. Adjustment of the distance between the axes of rotation of the two shaping rolls 54, 55 makes it possible to adjust engagement in such a manner that the tobacco foil web 50 passing through the gap between the shaping rolls 54, 55 is provided with a rib-type structure transversely to the direction of motion. If engagement is deep enough, the tobacco foil web may at the same time be stretched in the direction of motion between the individual ribs until a plurality of discontinuous small tears and openings is formed at these points in parallel with the transverse ribs. However, the continuity of the tobacco foil web in the direction of rotation must not be completely destroyed. The shaping rolls 54, 55 may both be driven but it is also possible to drive e.g. the lower shaping roll 55 only and to force the upper shaping roll 54 against the lower shaping roll 55 with an adjustable pressure so that it is moved by the latter's rotation.

The tobacco foil web 58 so provided with such transverse structures then passes to a further pair of associated shaping rolls 59, 60 which are designed similarly to the shaping rolls 15, 16 in FIG. 1 and possess engaging annular ribs similar to those shown in FIG. 2 and FIGS. 5 through 8. The tobacco foil web 61 emerging from this second pair of shaping rolls 59, 60 will then reveal superposed longitudinal and transverse structures and, provided that the shaping rolls 59, 60 are properly adjusted, a plurality of discontinuous longitudinal tears in parallel with the longitudinal ribs additionally to the discontinuous tears in parallel with the transverse ribs. In this manner very pronounced loosening and thinning of the tobacco foil web 61 is obtained without completely destroying its transverse or longitudinal continuity. Such a tobacco foil web 61 provided with rib-type structures in two normal directions and loosened when used as a filling of cigarette ensures particularly uniform burning. If required, the tobacco foil web 61 may pass through a drying device.

As previously stated, the tobacco foil web 50 in the embodiment according to FIG. 11 may have any width. Accordingly, the loosened tobacco foil web 61 is then subdivided into individual tobacco foil webs 63 and 64 respectively, which may be effected by a rotating cutter 62 of known design. The various tobacco foil webs 63, 64 must be of a width sufficient to provide the desired density of the cigarette filling after being gathered into an endless wrapped tobacco foil web and subdivided into cigarettes. The various shaped tobacco foil webs 63, 64 produced in one operation in an apparatus according to FIG. 11 are then individually wound into a bobbin of e.g. 1 to 1.5 m diameter and may then be conveyed to separate rope forming machines of known design where they are unwound, gathered in the transverse direction, wrapped and subdivided into individual cigarettes. Such a division of the production process into two consecutive production cycles is advantageous where a plurality of shaped tobacco foil webs is to be produced simultaneously from shaped tobacco foil webs and wound on bobbins. Since such bobbins may then be employed for feeding several rope forming machines, the rate of operation of the shaping apparatus according to FIG. 11 for the wide tobacco foil web need not correspond to the rate of operation of the individual rope forming machines, which may consititute an advantage.

In the embodiment described above in conjunction with FIGS. 1 and 11 it is contemplated that the tobacco foil web obtains a last structure as it passes shaping rolls 15, 16 and 59, 60 respectively which are provided with annular ribs so that ribs extending in the direction of motion are formed. This is always of advantage if the tobacco foil to be shaped would offer excessive resistance to gathering in the direction transverse to that of motion if it were not so structured in the longitudinal, i.e. if it is too stiff or brittle. For tobacco foil which can be gathered in the direction transverse to that of motion without difficulty also without such longitudinal structure, it is possible to contemplate other shapes if it is ensured that the permanent structures formed project from the flat tobacco foil in the upward and/or downward directions.

An embodiment of two associated shaping rolls 65 and 66 for the obtention of upwardly and downwardly directed humps in the passing tobacco foil web is shown in FIG. 13. Arranged on the surface of the rolls at appropriate distances from one another are projecting knobs 67 and 68 respectively which, if properly arranged in the radial direction of the two shaping rolls 65, 66, produce a structure according to FIG. 14 in the passing tobacco foil web. A tobacco foil web so structured will also produce a cigarette filling when gathered into a cylindrical rope transversely to the direction of motion, wrapped and subdivided into rods, the said filling having a plurality of tortuous hollow spaces interconnected from the front to the rear end which enable the smoke to pass through the cigarette.

A further embodiment of two suitable associated rolls 69, 70 is shown in FIGS. 15 and 16, the shaping roll 70 being here equipped with pyramid-shaped knobs 71. Conversely the roll 69 has an outer jacket 72 formed of soft rubber or paper into which the knobs 71 on the shaping roll 70 are forced in operation so that corresponding hump-type projections are formed in a passing tobacco foil web. Depending on the configuration of the projecting knobs on the surface of the shaping roll 70 humps of various configurations can be formed, by way of example the elongated humps 74 shown in the tobacco foil web in FIG. 17.

It is naturally also possible to arrange, as indicated in the apparatus according to FIG. 11, several pairs of shaping rolls behind one another and to shape a passing tobacco foil web repeatedly in a different manner. By way of example, as indicated in FIG. 18, a tobacco foil web 75 may first be provided with ribs 76 in the direction transverse to that of motion and then with humps 77, to which end, similarly to FIG. 11, a pair of shaping rolls 54, 55 is employed first and then a pair of shaping rolls 69, 70 (FIG. 15) having projecting elongated knobs afterwards. Again, it is also possible to provide hump-type deformations e.g. of the type described in conjunction with FIGS. 13 through 17 additionally to the rib-type deformations in the longitudinal direction as obtained with the shaping rolls according to FIGS. 2 and 5 through 8, to which end the tobacco foil web provided with longitudinal ribs must be passed between appropriate shaping rolls with projecting knobs.

Further embodiments of suitable shaping rolls are obtained, by way of example, by arranging a plurality of sawblade-type metal discs axially behind one another on a rotary shaft as shown diagrammatically in FIG. 19. If the teeth of those sawblades are all aligned behind one another in the axial direction, they will form a shaping roll which may produce similar indentations or humps in a tobacco foil web as the shaping roll 70 in FIGS. 15 and 16. If sufficiently sharp teeth are employed, humps with perforated points may be obtained in the tobacco foil web. On the other hand, shaping rolls according to FIG. 19, if the sawtooth blades are staggered in groups relative to one another, enable deformations of the type diagrammatically shown in FIG. 20 to be obtained, which are also serviceable for the present object. Similar deformations are also obtained if, with a shaping roll 15 e.g. according to FIG. 2, the annular ribs 18 are provided with radial notches at regular intervals so that rectangular teeth are formed. The annular ribs 19 of the shaping roll 16 may remain unslotted or receive similar radial notches. It should be pointed out that the various shaping rolls described in the foregoing constitute merely exemplary embodiments and that any shaping of a continuously moved tobacco foil web is suitable which produces permanent structures which project from the plane of the web. These structures must be suitable to produce, after gathering the tobacco foil web into a wrapped endless rope and its subdivision, a filling for cigarettes which possesses continuous passages for the smoke which are not straight. The stronger the thinning and fraying of the tobacco foil web, the more favourable the behaviour of the filling when such cigarettes are smoked.

The embodiment shown diagrammatically in FIG. 1 for the performance of this method for making cigarettes shows only a single continuous shaped tobacco foil web 17 which is supplied to the inlet funnel 20 of the rope forming machine 21. If desired, it is naturally possible to subdivide the shaped tobacco foil web 17 emerging from the last shaping rolls 15, 16 by means of suitable cutting devices, e.g. the rotating cutter 62 in FIG. 11, into two or more separate tobacco foil strips and to supply these to the inlet funnel 20 in arbitrary position. These separate strips will then be located in the wrapped endless tobacco foil rope 24 in arbitrary position relative to one another and more or less folded so that a plurality of individual layers is formed which are spaced from one another by a distance determined by the structures of the individual tobacco foil strips. FIG. 21 shows diagrammatically the irregular position of the various tobacco foil strips 79 loacted in the wrap 78, this simplified view indicating only humps 80 projecting from the surface of the tobacco foil strips 79. In reality the filling within the wrap 78 is much more compact and the individual strips are more or less folded together by gathering in the transverse direction. Within a rod of cigarette length of such a wrapped rope there exist a large number of continuous but tortuous smoke passages extending from the front end to the rear since the humps projecting from the tobacco foil strips ensure appropriate distances between adjacent layers.

The cigarettes made according to the embodiments of the present method above described consist of a filling in the wrap which is formed exclusively of one or several structured tobacco foil webs. If desired, it is also possible to provide a device in front of the inlet funnel for the tobacco foil webs in the rope forming machine which, by way of example, softens or renders sticky the upper face of the tobacco foil web and then to sprinkle normal cut tobacco on the passing tobacco foil webs so prepared. In this manner cigarettes may be made of which the filling consists of a plurality of structured tobacco foil layers with a certain quantity of normal cut tobacco between them in arbitrary arrangement.

In the application of the method above described for making cigars, the endless foil web consisting of a plurality of layers of structured tobacco foil is wrapped in a thin flat tobacco foil and subdivided into sections of a desired length. Every such length can then be covered with a wrapper in the known manner and formed into a point in the conventional manner at one or both ends.

The method of making cigarettes or other smoker's products above described for tobacco foil is also suitable for smoking foil which does not or only partly consist of tobacco components, e.g. for smoking foil made of substitute components or so-called artificial tobacco.

The production of structured smoking foil webs is suitable not only for making cigarettes or other tobacco products which consist exclusively or largely of such webs. It has proved to be of advantage to process such structured webs into a smoking material resembling cut tobacco by cutting and/or shredding. Such smoking material formed of structured webs or lengths is superior to that made of unstructured tobacco or smoking foil by cutting or shredding and used in the known manner as an addition to cut tobacco in cigarette fillings. The structured form and surface respectively of the smoking material made of fragmented structured smoking foil according to this invention possesses a lower weight per unit volume and, respectively, takes up more space than the same weight of fragmented but not structured smoking foil of the same weight by unit area. In addition, structuring and possibly fraying improves the burning properties of the smoking material according to this invention. This improved structured and fragmented smoking material may by way of example be made by supplying, according to the method described above with reference to FIG. 11, the bobbins wound with the individual structured foil 63 and 64 to the cigarette makers, where they are unwound and fragmented in shredders of known design for the purpose of being added to cut tobacco. Naturally such a fragmenting apparatus may be provided directly on an apparatus according to FIG. 1 instead of the rope forming machine 21 or according to FIG. 11 immediately after the pair of rolls 59, 60.

What is claimed is:

1. An improved method of making a smoking article from an endless web of reconstituted tobacco having a mass per unit length substantially equal to that of the smoking article to be made, including the steps of advancing the web along a path of travel, working the web as it travels to modify the structure thereof transversely of its length, forming the worked web as it continues to travel into a continuous rod, applying a wrapping to the rod and cutting the rod into lengths equal to that of the smoking article, the improvement being characterized in that the working is accomplished by longitudinally grooving the web while preventing any substantial transverse contraction thereof to both form therein a plurality of closely spaced narrow longitudinal corrugations and laterally stretch the material of the web to form therein closely-laterally-spaced narrow zones of lesser thickness extending longitudinally of the web wherein the fibers of the web material are loosened and exposed to provide projecting fiber ends and a plurality of discontinuous longitudinal tears without substantially impairing the longitudinal continuity of the web.

2. The method defined in claim 1 wherein the longitudinal grooving is accomplished by advancing the web through the bight between a pair of non-contacting meshing rotating rolls provided with narrow circumferential grooves alternating with narrow circumferential ribs which engage the web and prevent appreciable lateral contraction thereof.

* * * * *